United States Patent [19]

Miszak

[11] 4,144,846

[45] Mar. 20, 1979

[54] FORCED-FLOW STEAM GENERATOR

[75] Inventor: Pawel Miszak, Winterthur, Switzerland

[73] Assignee: Sulzer Brothers Ltd., Winterthur, Switzerland

[21] Appl. No.: 837,011

[22] Filed: Sep. 27, 1977

[51] Int. Cl.[2] ..... F22G 5/12; F22B 29/06

[52] U.S. Cl. ..... 122/479 R; 122/451 S; 122/479 S

[58] Field of Search ..... 122/459, 479 R, 479 S, 122/451 S, 487

[56] References Cited

U.S. PATENT DOCUMENTS

| | | | |
|---|---|---|---|
| 3,111,936 | 11/1963 | Brunner | 122/479 |
| 3,133,529 | 5/1964 | Wessely | 122/479 |
| 3,134,367 | 5/1964 | Halle | 122/479 |
| 3,769,942 | 11/1973 | Brehler | 122/479 |
| 3,850,148 | 11/1974 | Laubi | 122/479 |

*Primary Examiner*—Kenneth W. Sprague

*Attorney, Agent, or Firm*—Kenyon & Kenyon, Reilly, Carr & Chapin

[57] ABSTRACT

The forced-flow steam generator is provided with a control means for controlling the amount of water fed to the evaporator. The control means includes a controller which receives a load-dependent signal and an actual value signal from a temperature measuring means. The steam generator includes an injection line which communicates at a point downstream of the temperature measuring means. The controller may be connected directly to a valve in the injection line in order to regulate the amount of water which is bypassed around the evaporator or may be connected directly to the feedwater supply to maintain a constant flow to the evaporator during injection of water.

13 Claims, 6 Drawing Figures

FORCED-FLOW STEAM GENERATOR

This invention relates to a forced-flow steam generator. More particularly, this invention relates to a forced-flow steam generator and a control means for controlling the generator.

As is known, forced flow steam generators have been constructed with a feed water supply means, an economiser, evaporator, water separator and superheater connected in series relative to a flow of feed water. In some cases, the steam generator is provided with temperature measuring means upstream and downstream of the superheater as well as with at least one injection means for injecting water into the flow of working medium. If such a construction is operated under variable pressure, it is advantageous to operate the separator in a dry state above a given load limit, that is, up to that load at which water is circulated via the evaporator and the separator to ensure a sufficient flow of working medium. Such an operation is advantageous not only for thermal reasons but also for control reasons. However, it has been found that in steam generators constructed in this manner, water can pass into the separator in the event of a control disturbance at points above the given load limit. Because of the removal of the water from the heating surfaces, either due to removal from or storage in the separator, discontinuities result in the heating surface following the evaporator. This can lead to secondary control disturbances.

Accordingly, it is an object of the invention to construct a steam generator in a manner such that secondary flow disturbances are avoided with certainty.

It is another object of the invention to provide a control means for a forced flow steam generator which ensures the operation of a water separator in a dry state above a given load limit.

Briefly, the invention provides a forced-flow steam generator having a feed water supply means and a plurality of heating surfaces including an economiser, an evaporator, water separator and superheater which are connected in series relative to a flow of feed water with a control means for controlling the amount of water fed to the evaporator. The control means comprises a first temperature measuring means in a first region of the superheater for sensing the temperature of a flow of working medium thereat and for emitting an actual value signal in response thereto. In addition, an injection means is provided downstream of the temperature measuring means for injecting water into the flow of the working medium along with an injection line which is connected at one end to a point in the flow of feedwater between the economiser and the evaporator and at the opposite end to the injection means to deliver the water thereto. Also, a controller is provided for receiving a load-dependent signal and the actual value signal. This controller is connected to the injection line to influence the amount of feedwater flow through the evaporator in response to the differences between the two received signals. In this way, the temperature at the exit end of the evaporator is controlled above a given load limit by a reduction in the supply of feedwater to the evaporator to a limit preset in dependence on the load without a reduction in the flow of feedwater through the economiser.

In one embodiment, a valve is provided in the water injection line and the controller is connected to the valve in order to close the valve in response to an increase in the measured temperature and vice versa.

In a further embodiment, a valve is provided in the water injection line and a second temperature measuring means is connected downstream of the superheater for measuring the temperature of the working medium thereat. Also, a second controller is connected between the second temperature measuring means and the valve to open the valve in response to an increase in measured temperature and vice versa. In this embodiment, the first controller is connected to the feedwater supply means to maintain a constant flow of feedwater to the evaporator during injection of the water through the injection means.

These and other objects and advantages of the invention will become more apparent from the following detailed description and appended claims taken in conjunction with the accompanying drawings in which:

Figures 1, 2:
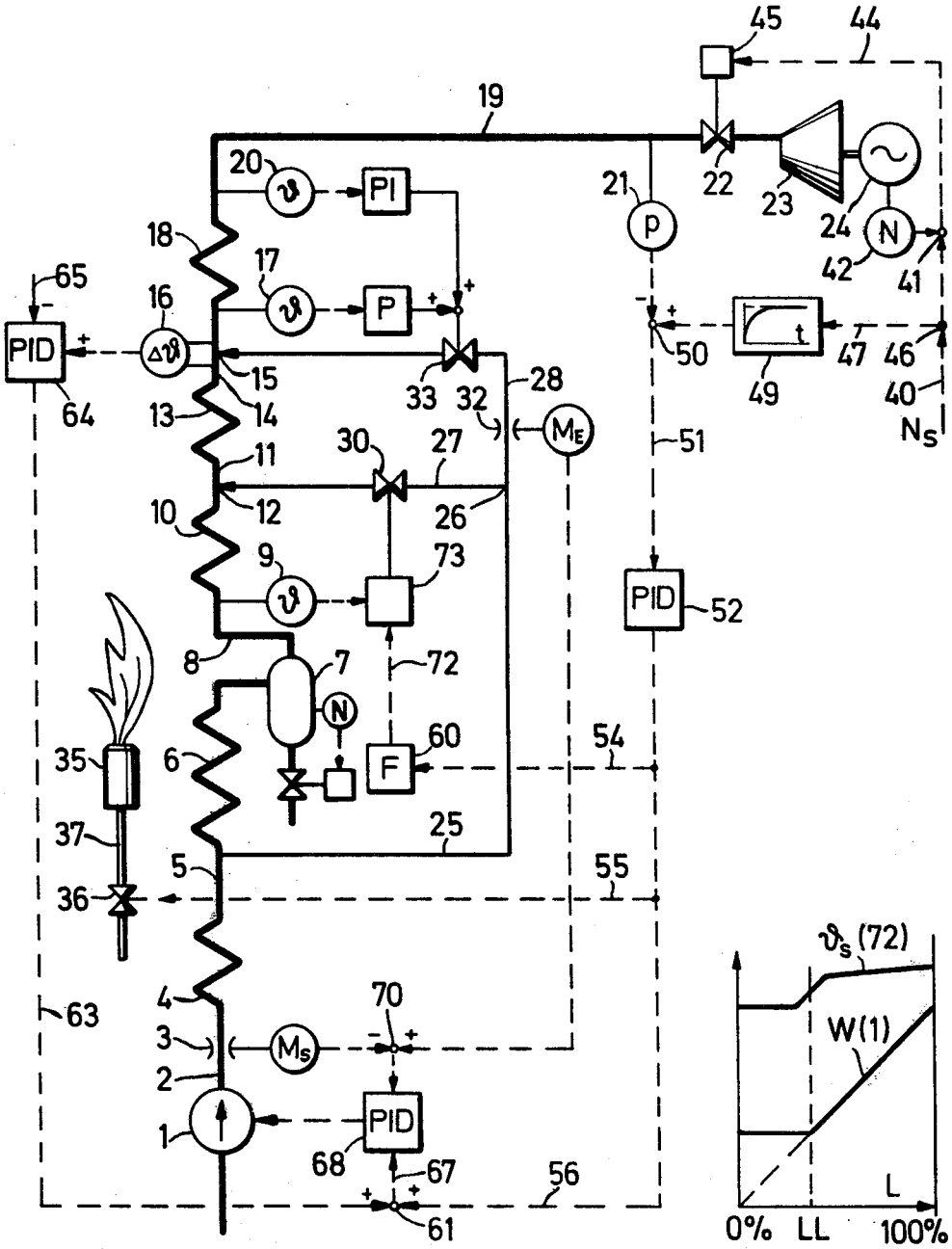
FIG. 1 illustrates a schematic view of a forced-flow steam generator according to the invention.
FIG. 2 illustrates a graphical representation of the supply of feedwater as a function of the load and the setpoint value as a function of the load.

Referring to FIG. 1, the forced-flow steam generator comprises a feedwater supply means 1 in the form of a feed pump for delivering a flow of feedwater via a line 2 with a flow meter 3 to an economiser 4. The generator also has a connecting line 5, an evaporator 6, a water separator 7, a connecting line 8 with a temperature measuring means 9, a first superheater part 10, a connecting line 11 with an injection means 12 and a second superheater part 13. In addition, the superheater is connected via a connecting line 14 to a final superheater 18. This connecting line 14 has a second injection means 15 therein, a transmitter 16 which is connected both upstream and downstream of the injection means 15 in order to measure the temperature difference $\Delta\theta$ occurring at the injection point, and a temperature measuring means 17 downstream of the transmitter 16. The final superheater 18 is connected via a live steam line 19 with a control valve 22 which leads to a turbine 23. In addition, a temperature measuring means 20 is disposed in the steam line 19 along with a pressure measuring means 21. As shown, the turbine 23 is connected to a generator 24 via a common shaft.

The steam generator is provided with a control means for controlling the amount of water fed to the evaporator 6. This control means includes a water injection line 25 which is connected at one end to a point at the flow of feedwater between the economiser 4 and the evaporator 6. The opposite end of the injection line 25 branches at a point 26 into two branch injection lines 27, 28. The first branch injection line 27 leads to the injection means 12 and has a valve 30 mounted therein. The other branch injection line 28 leads to the second injection means 15 and has both a flow meter 32 and a control valve 33 disposed therein.

A burner 35 is provided in the region of the evaporator 6 and is supplied with fuel via a line 37 equipped with a control valve 36.

The control means also includes a line 40 for delivering a set point load value signal $N_S$. This line 40 communicates with a reference point 41 which also receives an actual value signal from a power measuring device 42 connected to the generator 24 as is known. The reference point 41 allows a comparison of the actual value signal with the set point value $N_S$ to obtain a difference signal. This difference signal is fed via a line 44 to a controller 45 which actuates the live steam valve 22.

In addition, the set point value line 40 communicates via a branch point 46 and a line 47 with a time delay means 49 in order to deliver the set point load value signal $N_S$. The time delay member 49 further connects to a subtraction point 50 to deliver the set point value signal thereto along with an actual value signal emitted from the pressure measuring means 21 as a measure of the steam pressure. The two signals are compared at the subtraction point to produce a difference signal which is then fed via a line 51 to a load controller 52 which is of the PID type. The load controller 52, in turn, emits a load signal in response to the difference signal to three branch lines 54, 55, 56 to a function generator 60, the fuel valve 36 and to an addition point 61, respectively.

As shown, the transmitter 16 is connected to a regulator 64 which is of the PID type in order to deliver a signal representative of the temperature difference $\Delta\theta$. In addition, this regulator 64 receives a set point value signal via a line 65 and compares the set point value with the actual value signal of the temperature difference so as to emit a difference signal via a line 63 to the addition point 61. The sum signal formed by the addition at the addition point 61 is fed as the desired value via a line 67 to a feed controller 68 of the PID type. This controller 68 also receives an actual value signal which is formed by subtraction at a point 70 from the output signals of the two flow meters 3, 32. The controller 68 compares the received actual value and set point value signals to produce a control signal which is emitted for the control of the feed pump 1.

The function generator 60 is connected to the load controller 52 to receive the load signal via the line 54 and to emit a load-dependent signal in response thereto to a controller 73 via a line 72 as a set point signal. The controller 73 also receives the output signal of the temperature measuring means 9 as an actual value signal. The received signals are compared within the controller 73 and the output of the controller 73 acts on the valve 30 so that the valve closes if the temperature at the measuring means 9 rises and vice versa.

The control valve 33 in the branch injection line 28 is controlled on the one hand by the temperature measuring means 17 via a P-controller and, on the other hand, by the temperature measuring means 20 via a PI-controller to which a constant set point value (not shown) is transmitted.

The PID controller 68 is subordinated in the usual manner so that below a given load limit LL, the feed pump 1 supplies a constant minimal amount of feedwater as shown in FIG. 2 by the curve W (1) as a function of the load L. The function generator 60 is constructed so as to deliver a low set point signal as indicated by the curve $\theta_S$(72) as shown in FIG. 2 until shortly before the load limit LL and thereafter at a relatively steep rate to the temperature curve which is desired as a function of the generator output or the generator pressure. Because of the initially low set point value, the valve 30 remains closed in the lower load range.

In operation, in order to start up, the set point value for the boiler pressure is set by hand. The PID controller 68 thus feeds the minimum amount of water via the feed pump 1 to the evaporator 6. This water returns from the separator 7 into a starting-up tank (not shown). At this time, the valves 30 and 33 are closed. The burner 35 is now ignited and the output increased on a successive basis. The system pressure as measured by the pressure measuring means 21 begins to rise and steam develops in the evaporator 6 to cool the superheating surfaces 10, 13, 18. This steam initially flows off via a bypass system (not shown) which is connected upstream of the live steam valve 22. In the further course of starting up, the output of the burner 35 rises so high that the amount of water at the exit of the evaporator 6 is only still a few percent. Under this condition, the set point value fed by the function generator 60 to the controller 73 now rises in ramp fashion as indicated in FIG. 2. Since the temperature at the point 9 does not yet reach the increased set point value, the valve 30 opens. Thus, the water supplied to the evaporator 6 is reduced because of the water removal via the injection line 25. This causes heating of the working medium at the exit of the evaporator 6 to the desired value. If the temperature at the temperature measuring means 17, 20 rises to too high a value, water is injected via the line 28. The amount of injected water is measured by the flow meter 32 and a responsive signal is emitted to the feed controller 68 and thus to the feed pump 1. The feed pump output is corrected via the transmitter 16 and the controller 64 in such a manner that the temperature difference at the injection means 15 remains substantially constant. The turbine 23 is now started up by opening the valve 22 whereby the bypass system is closed.

The external control now proceeds as follows. Due to the desired output value which is set via the line 40, the valve 22 is controlled as described above while the output of the controller 52, delayed by the time delay means 49, dictates the boiler load.

The load dependent control of the temperature and the enthalpy, respectively, at the entrance of the superheater not only has the advantage of achieving a better stability of the control but also ensures a greater latitude in the disposition of the heating surfaces in the construction of the steam generator.

Figure 3:
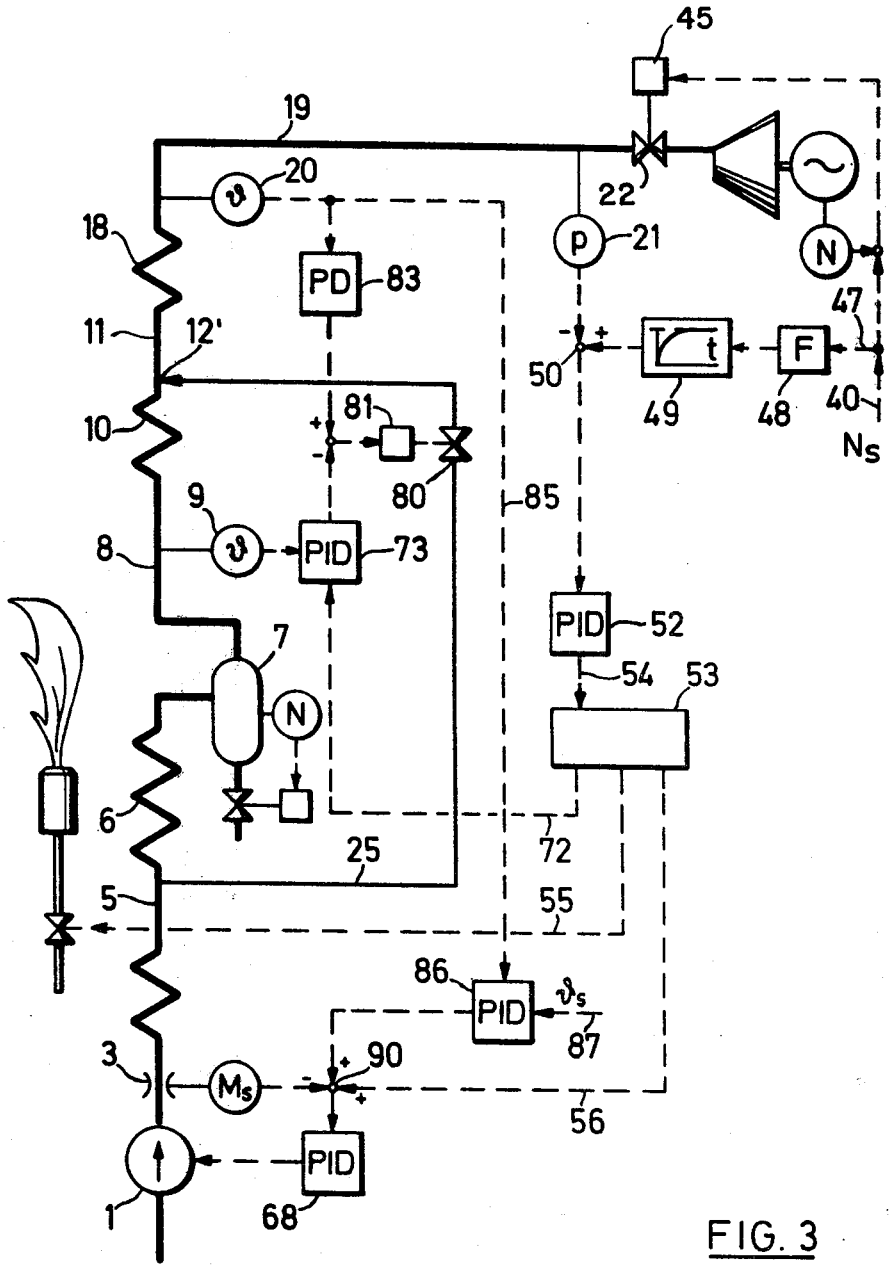
FIG. 3 illustrates a modified forced-flow steam generator in accordance with the invention.

Referring to FIG. 3, wherein like reference characters indicate like parts as above, the steam generator may be simplified by using only a single injection means 12'. In this case, the sole injection valve 80 which is mounted in the injection line 25 is controlled by a servomotor 81 which, in turn, is controlled by a PID controller 73 and a PD controller 83. As shown, the PID controller 73 is supplied via a line 72 with a load dependent setpoint value from a load programmer 53 comprised of several function generators. In addition, the actual value signal from the temperature measuring means 9 is also supplied to the controller 73. The PD controller 83 is influenced by the temperature measuring means 20 which also acts via a line 85 on a final temperature controller 86 having a PID characteristic. This latter controller 86 is fed with a set point value for the boiler exit temperature via a set point line 87. The output of the controller 86 is delivered to an addition point 90 to which a load signal from the load programmer 53 is fed via a line 56 as the actual value and a feed rate signal is delivered from the flow meter 3 as a negative quantity.

The arithmatic sum of the three signals is fed from the addition point 90 to the feed controller 68 which acts on the feed pump 1.

The external steam generator control is of the same construction and operation as described in FIG. 1 with the sole difference that the signal line 47 also has a function generator 48 therein to permit a non-linear interlinking of the pressure set point value with the steam generator output.

The construction shown in FIG. 3 has an advantage in requiring a smaller expenditure for valves, control equipment and collectors. However, there is a disadvantage that if the separator 7 is operated wet, the live steam temperature can be regulated only to a small permanent deviation stemming from the absence of an I component at the controller 83. If this deviation is not permissible, then an I member 93 can be provided in parallel to the PD controller 83 as shown in FIG. 4.

Figure 4:
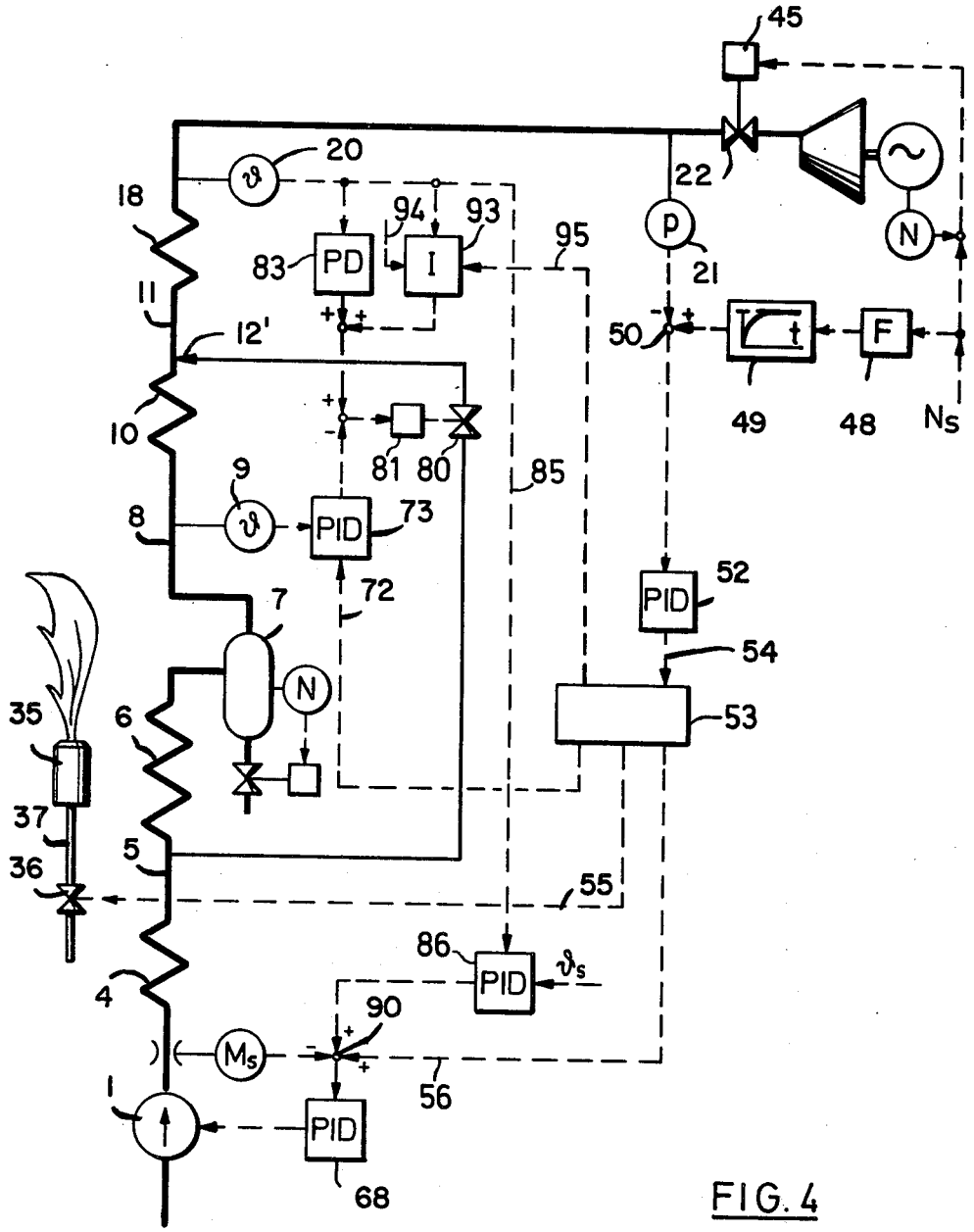
FIG. 4 illustrates a further modified forced-flow steam generator in accordance with the invention.

Referring to FIG. 4, wherein like reference characters indicate like parts as above, the I member 93 is supplied with a set point value for the live steam temperature via a line 94 and branches from the temperature measuring means 20. In addition, the I member 93 is connected or disconnected in dependence on the load via a line 95 from the load programmer 53 depending on whether the load limit is exceeded downwards or upwards. The I member 93 then assumes the function of the I component of the controller 86 if the controller 86 can no longer become effective because the separator 7 is operated in a wet state. The switching over signal which is transmitted via the line 95 can also come from the position of the valve at the separator 7.

Figure 5:
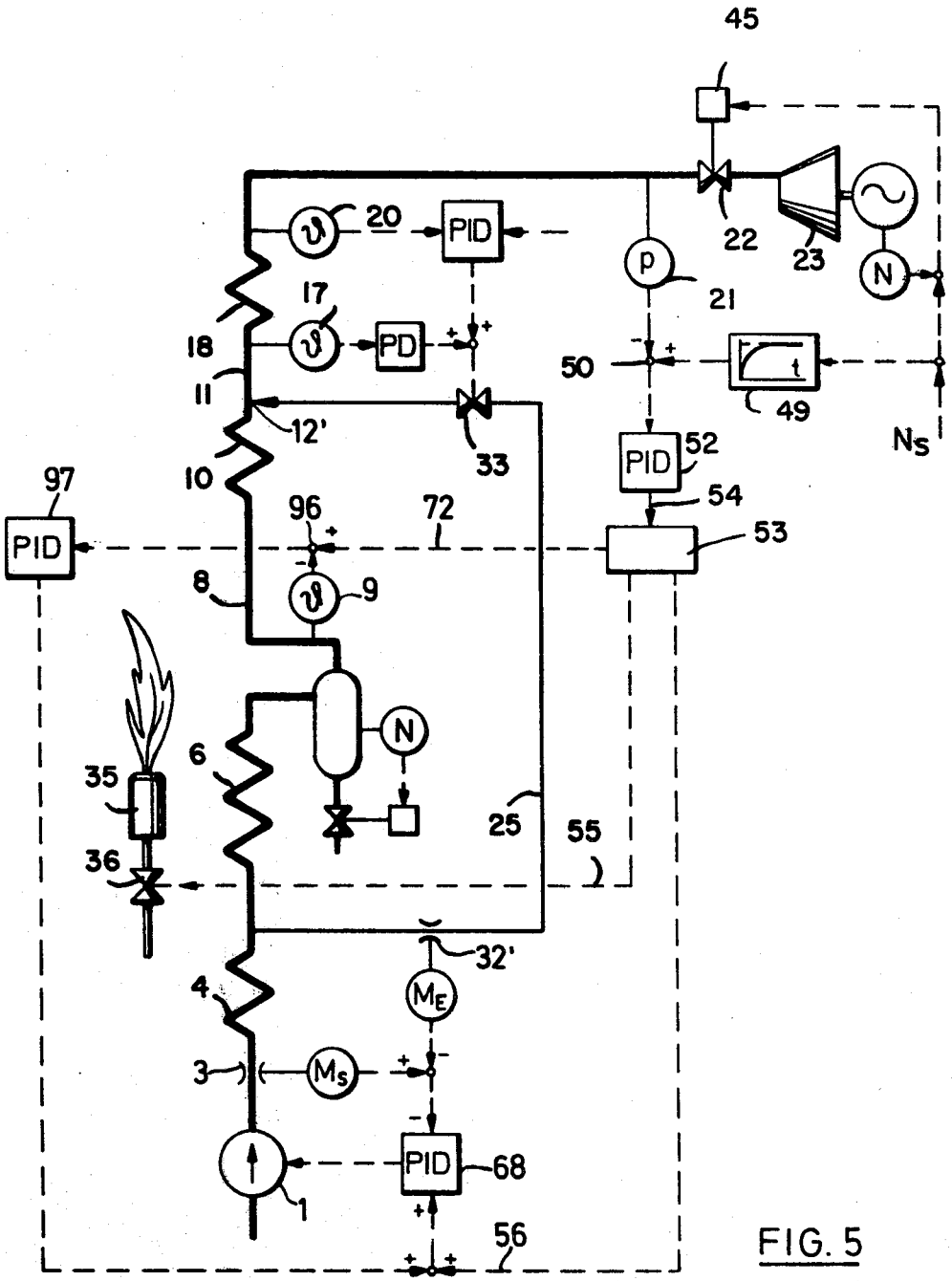
FIG. 5 illustrates a modified forced-flow steam generator in which the control means directly controls the feedwater supply in accordance with the invention.

Referring to FIG. 5, wherein like reference characters indicate like parts as above, the forced-flow steam generator may alternatively be constructed so that the output signal of the measuring means 9 is compared with a set point signal from the load programmer 53 which is transmitted via a line 72 in a subtraction point 96. Any deviation which is formed is then transmitted to a PID controller 97 which forms an output signal which is transmitted as a set point value to the feed controller 68 along with a load signal from the load programmer 53 via a line 56 as a disturbance variable period. The actual value of the feed controller 68 is formed in a similar manner as described above with respect to FIG. 1; however with the difference that not only a part but the total of the injection amount is measured by a flow meter 32' arranged in the water injection line 25.

Figure 6:
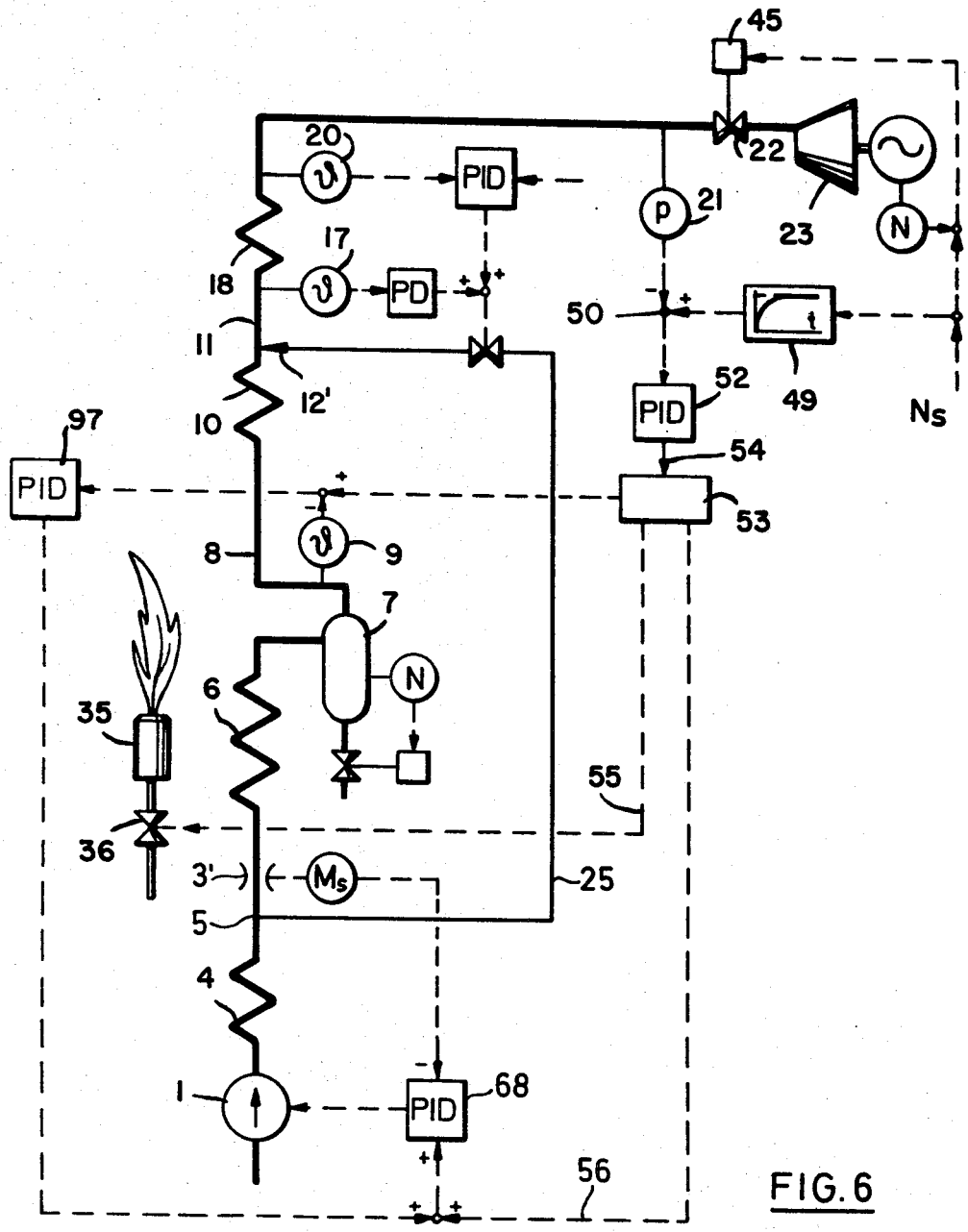
FIG. 6 illustrates a further modified steam generator similar to that of FIG. 5.

Referring to FIG. 6, wherein like reference characters indicate like parts as above, the forced-flow steam generator as shown in FIG. 5 may be varied by having only a single flow meter 3' arranged immediately upstream of the evaporator entrance, i.e. downstream of the branching off point of the injection water line 25 from the line 5 instead of the two flow meters 3 and 32' shown in FIG. 5. This variant has the advantage over that of FIG. 5 in that one of the flow meters and the comparator device shown therein can be omitted.

Finally, referring to FIG. 1, in a similar manner to FIG. 6 the injection lines 28 and 27 can be connected directly and in that order, to the connecting line 5. Also, instead of using the measuring means 3, 32, a measuring means can be arranged between the two connecting points with an output connected as the actual value to the feed controller 68. Also, an enthalpy measuring device can be substituted for the temperature measuring means 9.

What is claimed is:

1. A forced-flow steam generator comprising a feedwater supply means for delivering a flow of feedwater;

a plurality of heating surfaces including an economizer, an evaporator, a water separator and a superheater connected in series;

a first temperature measuring means in a first region of said superheater for sensing the temperature of a flow of working medium thereat and emitting an actual value signal in response thereto;

a second temperature measuring means at an end of said superheater and downstream of said first temperature measuring means relative to the flow of working medium for measuring the temperature of the working medium thereat;

at least one injection means between said first and second temperature measuring means for injecting water into the flow of working medium;

an injection line connected at one end to a point in the flow of feedwater between said economizer and said evaporator and at an opposite end to said injection means to deliver water thereto; and a controller responsive to said actual value signal of said first temperature measuring means and a load-dependent signal as a set point signal for influencing the amount of water fed to said evaporator.

2. A forced-flow steam generator as set forth in claim 1 which further comprises a function generator connected to said controller to receive a load signal and to deliver the set point signal to said controller in response to the load signal, said set point signal rises in ramp-fashion with an increasing load signal in at least the load region of a transition from a wet state to a dry state in said separator.

3. A forced-flow steam generator as set forth in claim 1 which further comprises a valve in said line, said controller being connected to said valve to actuate said valve for influencing the extraction of water between said economizer and said evaporator.

4. A forced-flow steam generator as set forth in claim 1 which further comprises a second injection means upstream of said second temperature measuring means, said injection means being connected to said injection line.

5. A forced-flow steam generator as set forth in claim 1 which further comprises a valve in said injection line, and a second controller having a PD characteristic connected to said second temperature measuring means to emit a signal responsive to the measured temperature; and wherein said first controller has an integral component; said controllers delivering superposed signals to said valve.

6. A forced-flow steam generator as set forth in claim 5 which further comprises a third controller having an I-characteristic connected to and between said second temperature measuring means and said feedwater supply means for regulating the flow of feedwater as a function of the measured temperature of the working medium.

7. A forced-flow steam generator as set forth in claim 6 which further comprises a fourth controller having an I-characteristic connected in parallel with said second controller relative to said second temperature measuring means and said valve.

8. A forced-flow steam generator as set forth in claim 1 wherein said controller is connected to said feedwater supply means to maintain a constant flow of feedwater to said evaporator during injection of water through said injection means into the flow of working medium.

9. A forced-flow steam generator as set forth in claim 8 which further comprises a flow meter disposed between said connecting point of said injection line and said evaporator for measuring the flow of feedwater, and a second controller for receiving an actual value signal from said flow meter and a signal from said first controller to control said feedwater supply means.

10. In combination with a forced-flow steam generator having a feedwater supply means, an economiser, an evaporator, a water separator and a superheater connected in series relative to a flow of feedwater; a control means for controlling the amount of water fed to said evaporator, said control means comprising a first temperature measuring means in a first region of said superheater for sensing the temperature of a flow of working medium thereat and for emitting an actual value signal in response thereto;

an injection means downstream of said temperature measuring means for injecting water into the flow of working medium;

an injection line connected at one end to a point in the flow of feedwater between said economizer and said evaporator and at an opposite end to said injection means to deliver water thereto; and a controller for receiving a load-dependent signal and said actual value signal and connected to said injection means to influence the amount of feedwater flow through said evaporator in response to the differences between said signals whereby the temperature at the exit end of said evaporator is controlled above a given load limit by a reduction in the supply of feedwater to said evaporator to a limit preset in dependence on the load without a reduction in the flow of feedwater through said economizer.

11. The combination as set forth in claim 10 which further comprises a line for delivering a setpoint load value signal, a time delay means connected to said line for receiving said setpoint load value signal, a pressure measuring means connected to said steam generator downstream of said superheater to measure the pressure of the working medium and to emit an actual value signal in response thereto, a subtraction point for comparing said set point value signal from said time delay means with said actual value signal from said pressure measuring means to obtain a difference signal, a load controller having a PID characteristic for receiving the difference signal and emitting a load signal in response thereto; and a function generator connected to said load controller to receive the load signal and to emit the load-dependent signal in response thereto to said controller as a set point signal.

12. The combination as set forth in claim 11 wherein said control means further comprises a valve in said injection line, said controller being connected to said valve to close said valve in response to an increase in measured temperature at said temperature measuring means and vice versa.

13. The combination as set forth in claim 11 wherein said control means further comprises a valve in said injection line, a second temperature measuring means connected at the end of said superheater for measuring the temperature of the working medium thereat, and a second controller connected between said second temperature measuring means and said valve to open said valve in response to an increase in measured temperature at said second temperature measuring means and vice versa, said first controller being connected to said feedwater supply means to maintain a constant flow of feedwater to said evaporator during injection of water through said injection means.

* * * * *